US009555430B2

(12) United States Patent
Sulzer et al.

(10) Patent No.: US 9,555,430 B2
(45) Date of Patent: Jan. 31, 2017

(54) PAINT APPLICATION SYSTEM

(71) Applicant: J. Wagner GmbH, Markdorf (DE)

(72) Inventors: Christopher J. Sulzer, Minneapolis, MN (US); Andreas Abt, Frickingen (DE); Jens Ulbrich, Friedrichshafen (DE); Thomas Jeltsch, Friedrichshafen (DE)

(73) Assignee: J. Wagner GmbH, Markdorf (DE)

( * ) Notice: Subject to any disclaimer, the term of this patent is extended or adjusted under 35 U.S.C. 154(b) by 0 days.

(21) Appl. No.: 14/680,474

(22) Filed: Apr. 7, 2015

(65) Prior Publication Data

US 2015/0283567 A1 Oct. 8, 2015

(30) Foreign Application Priority Data

Apr. 8, 2014 (DE) ..... 10 2014 105 016

(51) Int. Cl.

| | |
|---|---|
| ***B05B 1/30*** | (2006.01) |
| ***B05B 12/00*** | (2006.01) |
| ***B05B 7/24*** | (2006.01) |
| ***B05B 7/26*** | (2006.01) |
| ***B05B 11/00*** | (2006.01) |
| ***B05B 7/00*** | (2006.01) |
| ***B05B 12/08*** | (2006.01) |

(Continued)

(52) U.S. Cl.

CPC ..... *B05B 12/008* (2013.01); *B05B 7/0081* (2013.01); *B05B 7/2489* (2013.01); *B05B 7/2494* (2013.01); *B05B 7/262* (2013.01); *B05B 11/30* (2013.01); *B05B 12/088* (2013.01); *B05B 7/0416* (2013.01); *B05B 9/042* (2013.01)

(58) Field of Classification Search

CPC ..... B05B 9/01; B05B 1/14; B05B 12/002; B05B 15/00

USPC ..... 239/68, 525, 526, 581.2

See application file for complete search history.

(56) References Cited

U.S. PATENT DOCUMENTS 1,940,268 A * 12/1933 Peterson ..... B05B 7/0815 239/300

4,212,591 A 7/1980 Lamontagne et al.

(Continued)

FOREIGN PATENT DOCUMENTS

DE 914 351 B 7/1954

DE 32 08 464 C2 7/1998

(Continued)

OTHER PUBLICATIONS

Extended European Search Report (Application No. 15162373.3) dated Aug. 24, 2015.

(Continued)

*Primary Examiner* — Davis Hwu

(74) *Attorney, Agent, or Firm* — Burr & Brown, PLLC

(57) ABSTRACT

A paint spraying system is proposed with a paint spraying device with a paint spray gun with a fan for dispensing paint via a spray head, which paint spraying device is connected via a paint line to a base station with a connector to a paint reservoir. In order to achieve a low and uniform paint pressure which is required in the paint spray gun, the paint spray gun is equipped with a separate pressure reducing device and the base station is equipped with a pressure monitor, which pressure reducing device and pressure monitor perform a pressure regulation of the paint pressure in the system.

10 Claims, 2 Drawing Sheets

(51) Int. Cl.
*B05B 7/04* (2006.01)
*B05B 9/04* (2006.01)

(56) References Cited

U.S. PATENT DOCUMENTS

| | | | | |
|---|---|---|---|---|
| 4,397,610 | A | 8/1983 | Krohn | |
| 6,021,965 | A * | 2/2000 | Hartle | B05B 5/1608 138/120 |
| 2003/0146304 | A1 * | 8/2003 | Anthony | B05B 7/0081 239/526 |
| 2005/0269425 | A1 | 12/2005 | Gohring et al. | |
| 2009/0008481 | A1 | 1/2009 | Smith et al. | |
| 2012/0261500 | A1 | 10/2012 | Krayer et al. | |
| 2014/0145003 | A1 | 5/2014 | Schmon et al. | |

FOREIGN PATENT DOCUMENTS

| | | | |
|---|---|---|---|
| DE | 10 2010 060 086 | A1 | 4/2012 |
| EP | 1 602 411 | B1 | 8/2008 |
| WO | 97/03756 | A1 | 2/1997 |
| WO | 2011/038712 | A1 | 4/2011 |

OTHER PUBLICATIONS

German Search Report (Application No. 10 2014 105 016.9) dated Jan. 29, 2015.
U.S. Appl. No. 14/680,509, filed Apr. 7, 2015, Andreas Abt.

* cited by examiner

PAINT APPLICATION SYSTEM

This application claims the benefit under 35 USC §119 (a)-(d) of German Application No. 10 2014 105 016.9 filed Apr. 8, 2014, the entirety of which is incorporated herein by reference.

FIELD OF THE INVENTION

The invention relates to a paint application system.

BACKGROUND OF THE INVENTION

A multiplicity of air-powered paint spraying systems exist in the prior art which as a rule comprise an apparatus for air flow generation, for example, a compressor or a fan, and a spray gun. If a relatively small paint supply is used, it is fastened to the spray gun (see, for example, EP 1 602 411 B1). If a relatively large paint supply is provided, it is handled in a separate and stationary manner, for example, in a bucket or container, the operating part with paint spraying lance and spray head representing a transportable part and being connected via a connector hose (see, for example, WO 2011/038712 A1).

In what are known as HVLP (high-volume, low-pressure) systems, the paint is atomized in a known way at a low air and paint pressure by means of a large air volume, for example, by a fan. This differs, for example, from what is known as an airless method, in which the paint is atomized by way of very high paint pressure. Here, the fan and the paint pump are either accommodated in the gun unit or, as an alternative, in a base unit. The air and the paint are combined in the spray head and the paint is atomized in a known way.

In the case of a multiple-piece paint spraying system with a separate base station, the paint transport takes place via a paint pump which is provided in the base station, sucks in the paint from a paint bucket or another storage container and delivers it to the paint spray gun or a paint roller or the like via a paint hose which is possibly several meters long. Depending on the viscosity of the paint and the length of the paint hose and the relatively small cross section of the paint hose, a considerable paint pressure is necessary on the part of the paint pump in the base station, in order to deliver the paint to the paint application tool, for example, a paint roller, brush or a paint spray gun. In the case of highly viscous paints and a paint hose length of, for example, more than from 5 m to 8 m and a paint hose internal diameter of, for example, only from 6 mm to 8 mm, paint pressures of from 2 bar to 8 bar are necessary, for example, in order to overcome the pressure drop which occurs in the paint hose. Here, the actual spraying operation in the paint spray gun is carried out at a relatively low paint pressure of, for example, only from approximately 0.3 bar to 0.4 bar.

The pressure reducing device/pressure regulator which is essential as a constituent part in the present invention is described and claimed in detail in the parallel patent application having the file number DE 10 2014 104 982.9. Reference is made hereby to the disclosure of the patent application and its contents are made the contents of this application by way of reference.

As a result of the long hose and the associated elasticity effects, for example, as a result of a partially elastic hose material or the inherent dynamic inertia of the transported liquid (paint), a considerable hysteresis is produced between the pressure which is provided by the paint pump at the base station and the pressure at the transportable element, for example, the paint roller or the paint spray gun.

In particular, the spraying operation at the spray head itself should be carried out at an appropriately lower pressure, in order to avoid uncontrolled paint discharge, what is known as "spitting" during opening of a needle valve on the spray head. If this is not realized, an inhomogeneous paint application results on account of fluctuating dispensed quantities of atomizable paint at the paint spray head. In the prior art, this effect is avoided by way of switching the paint delivery on and off in accordance with the paint quantity to be dispensed. However, this necessitates complex and brief switching operations which make the corresponding units complicated, susceptible to disruption and expensive. Paint rollers or paint brushes also have to be supplied continuously with paint, without material pulses of paint being dispensed when a valve is opened.

In the context of the invention, a paint inlet line is to be understood to mean a line of the type which is provided for feeding paint to a paint dispensing apparatus, for example, to a spray gun, and is connected upstream of a pressure regulator. In the context of the invention, a paint inlet line can also be understood to mean a paint hose.

In the context of the invention, a paint dispensing line is to be understood to mean a line of the type which is connected downstream of a pressure regulator and is provided for feeding paint to the outlet of a paint dispensing apparatus, for example a spray gun. In the context of the invention, the paint dispensing line is arranged within a paint dispensing apparatus, for example a spray gun.

SUMMARY OF THE INVENTION

The invention is based on the object of proposing a paint application system which makes a regulation of the paint pressure possible both in the base station and in the spray gun, in order to generate a homogeneous paint application on account of an operating pressure which is as constant as possible in the spray gun or the like.

The invention relates to a paint application system having a transportable paint roller, paint brush, paint pad, etc., or a transportable paint spraying device or paint spray gun with a fan for dispensing paint via a spray head with a paint nozzle and a needle valve; furthermore, having a base station which is stationary during the work operation for paint application and has a connector to a paint supply, the base station having a paint pump for sucking in paint from the paint supply and delivering paint by means of pressure, and the base station being connected to the paint roller, etc. or the paint spraying device via a paint hose and supplying the paint roller, etc. or the paint spraying device with paint.

According to the invention, the paint roller, etc. or the paint spraying device comprises a pressure reducing device/pressure regulator which is connected downstream of the paint hose and regulates the paint pressure in a paint dispensing line to a paint roller, etc. or a paint spray head to a substantially constant paint pressure which is lower than a paint pressure in the paint hose, and the paint pump in the base station is assigned a pressure monitor for monitoring the required paint pressure at the paint pump-side end of the paint hose.

The paint application system according to the invention provides the necessary operating pressure of the paint in the paint hose via the paint pump and the pressure monitor which is arranged there. At the same time, it is ensured via the pressure reducing device/pressure regulator at the transportable work implement, for example the paint roller, paint brush, paint pad or a paint spraying device that merely the operating pressure which is necessary for controlled and quality-optimized processing of the paint is available for paint dispensing.

This interplay allows it to be possible for a paint delivery pressure in the paint hose to be provided by the paint pump independently of the processing paint pressure.

In the following text, the use of a paint spray gun will be described substantially. However, the invention is not restricted hereto; transportable paint rollers which are fed via a paint pump, corresponding paint brushes or paint pads, etc. are also the subject matter of the present invention.

It is provided in one expedient development that communications about the paint pressure are performed between the pressure reducing device/pressure regulator and the pressure monitor in such a way that a paint pressure which falls below a first limiting value is detected in the paint hose at the paint pump-side end by the pressure monitor and actuates a switch which switches on the paint pump in order to generate a higher paint pressure in the paint hose, and a paint pressure which rises above a second limiting value at the pressure reducing device/pressure regulator is communicated to the pressure monitor via the paint pressure and actuates a switch which switches off the paint pump.

It is provided in this embodiment that the paint pump does not run continuously even during work operation, but rather supplies the system with a paint pressure which lies within certain limiting values, as a result of which the pump wear is reduced and/or pressure-loaded connector regions are protected.

It is provided in a further expedient embodiment that a first regulating circuit is provided for regulating the paint pressure at the outlet of the paint pump, and a second regulating circuit is provided for regulating the paint pressure at the paint dispensing line.

The aim is to set a substantially constant paint dispensing pressure in a paint dispensing line at a paint dispensing means, for example a paint spray gun, a paint roller or the like. The use of two regulating circuits which firstly, in the first regulating circuit, regulates the paint pressure at the outlet of the paint pump in order to provide a paint pressure in the paint hose as far as the paint dispensing unit, and secondly comprises a second regulating circuit for regulating the paint pressure for the paint dispensing line, allows the behaviour of a long and elastic paint hose between the devices, which behaviour is difficult in terms of regulation technology, to be controllable and to be capable of being used in the application.

Moreover, it is provided that the pressure monitor is arranged between the paint pump and the paint hose in the base station.

The arrangement of the pressure monitor in the base station upstream of the paint hose makes improved and simple feedback to the paint pump possible, since the complete paint pressure which prevails in the paint hose is available for the pressure monitor. Moreover, the accommodation in a compact module is made possible.

It is preferably provided to provide the pressure monitor in a first regulating circuit via a hydraulic control line, as measuring element, with a switch which can be operated via the said hydraulic control line. Here, the switch is set via a corresponding prestressing means in such a way that the required hysteresis during switching on and off of the paint pump is achieved. A regulating loop achieves a situation where the paint pump always provides a necessary minimum pressure in the paint hose, exceeds the said minimum pressure, and switches off at an upper limiting value of the pressure.

Here, the hydraulic control line is preferably configured as a flexible line, in particular as a rubber line, in order, via its inherent elastic extensibility, to buffer additional hysteresis effects and/or slight pressure fluctuations in the system, for example pulses of the paint pump. The laying of the line in the housing, in particular at potential-free locations, is also simplified in this way.

Moreover, it is provided in a preferred way that a control fluid in the form of oil is arranged in the hydraulic control line. Control fluids of this type afford particularly advantageous properties during the transmission of the pressure to the switch, in particular via a pressure diaphragm.

Furthermore, it is expedient that coupling means between the pressure monitor and the paint line are configured as a pressure diaphragm, the said coupling means being integrated substantially without edges and dead spaces into a paint duct on the pressure side of the paint pump. Stagnation points or constrictions in the region of the pressure monitor in the paint duct are disadvantageous and should be avoided, since they falsify the corresponding detected pressure. The arrangement of the coupling means as a pressure diaphragm is therefore to be carried out at the paint pump, in particular in the region of a wall of the paint dispensing means.

It is expedient to configure the paint pump as a peristaltic pump. Pumps of this type are established and can provide corresponding paint pressure ranges.

It is provided in a further preferred embodiment that, in a second regulating circuit, the pressure reducing device/pressure regulator functions as a measuring element via a hydraulic force sensor. The method of operation of the pressure reducing device/pressure regulator is explained in detail in the parallel German patent application DE 10 2014 104 982.9 which was indicated at the outset. Reference is herewith made thereto and its contents are made the disclosure and the subject matter of this application, in particular the use of the said pressure reducing device/pressure regulator in the second regulating circuit.

BRIEF DESCRIPTION OF THE DRAWINGS

In the following text, the invention is to be explained in greater detail using a diagrammatic exemplary embodiment.

DETAILED DESCRIPTION OF THE INVENTION

Figure 1:
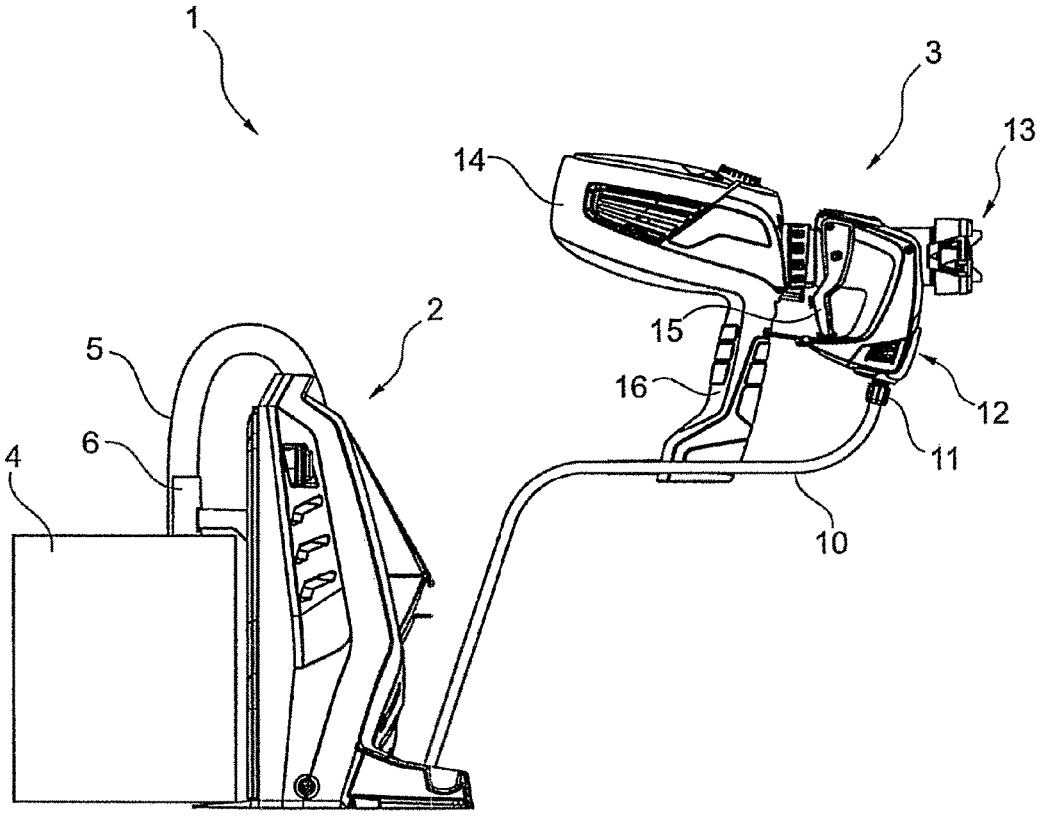
FIG. 1 shows an arrangement of a paint application system with a paint supply, a base station and a paint spray pistol.

In detail, FIG. 1 shows a paint application system 1 which comprises a base station 2 and a paint spray gun 3 and a paint supply in the form of a paint bucket 4. Here, the base station 2 is attached to the paint bucket 4 via a paint intake line 5 which is held in a hose guide 6. Starting from the base station 2, a paint pressure line 10 leads to a connector 11 on the pressure reducing device/pressure regulator 12 on the paint spray gun 3. The pressure reducing device/pressure regulator 12 is arranged below a spray head 13, at which the paint is atomized and dispensed in a known way by way of an air flow from a fan 14. In order to control the dispensing of paint and/or the fan 14, a trigger 15 is provided in the region of a handle 16, which trigger 15 preferably operates a needle valve. If the trigger 15 is then released when paint is provided in the paint pressure line 10, no paint is dispensed from the spray head 13. A back-pressure of paint builds up in the pressure reducing device/pressure regulator 12 via the connector 11 and the paint pressure line 10 as far as the base station 2. The paint pump is arranged in the base station 2, which paint pump is then deactivated via the pressure monitor when a predefined maximum pressure is reached.

The technical interaction of the individual components is to be explained in greater detail in the following text using FIG. 2.

Figure 2:
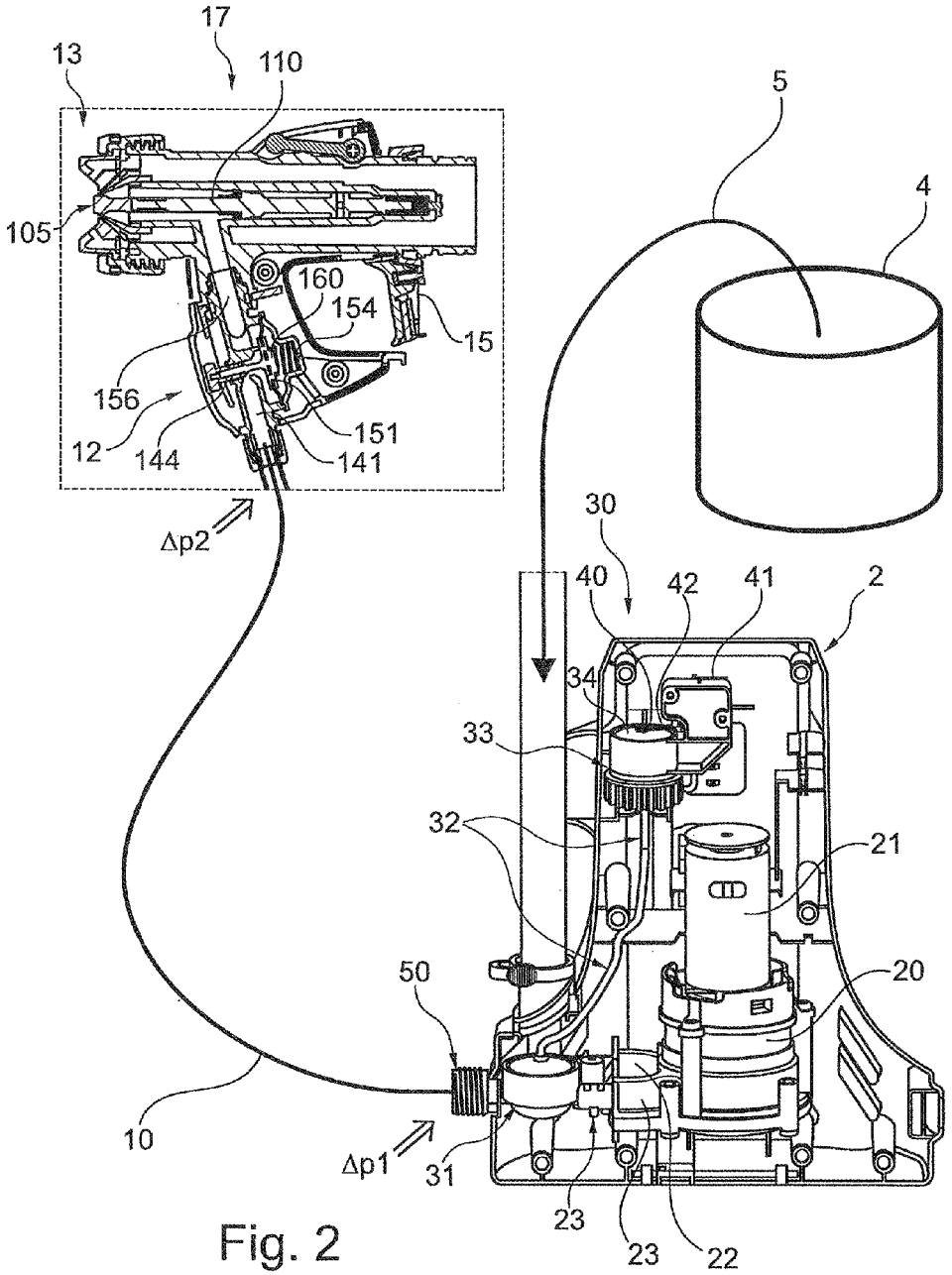
FIG. 2 shows a detailed illustration of the base station with paint pump and pressure monitor, and of the paint spray gun with pressure reducing device/pressure regulator.

FIG. 2 shows the open housing of the base station 2 and a diagrammatically shown paint bucket 4 which is connected to the base station 2 via a paint intake line 5. Furthermore, FIG. 2 diagrammatically shows the paint pressure line 10 which leads from the base station 2 to a front part of a paint spray gun 3, what is known as a front end 17.

In the following exemplary embodiment, the arrangement according to the invention exhibits two regulating circuits which are coupled via the paint pressure line 10.

A peristaltic pump 20 with a pump motor 21 is arranged in the base station 2. The paint intake line 5 is guided via the pump inlet 22 to the peristaltic pump 20, and the peristaltic pump 20 produces a paint pressure at the pump outlet 23, which paint pressure is provided in accordance with the pump performance of the said peristaltic pump 20. A paint pressure of 8 bar±2 bar is advantageously set as a controlled variable at this location, namely at the pump outlet 23. Other paint pressures which are appropriate depending on the application are likewise conceivable.

A constituent part of the pressure monitor 30 is situated connected to the pump outlet 23, which pressure monitor 30 records the paint pressure at the pump outlet as a measured variable via a membrane coupling 31 in a volume, through which flow passes. The paint pressure at the pump outlet 23 is transmitted via the membrane coupling 31 to a hydraulic control line 32 which leads as a flexible line which can be laid in the housing to a membrane switch 33. An advantage of the flexible hydraulic control line 32 is that it can be routed in the housing in virtually any desired, but kink-free paths, and no potential guiding of an electric switching operation has to take place in the region of the pump outlet 23 and the paint pressure region. The hydraulic control line 32 opens onto the membrane switch 33 which has a membrane 34 on the top side. The membrane 34 is moved by way of the paint pressure which is transmitted by means of the hydraulic control line 32, preferably is raised up, and therefore likewise lifts a spring lever 40 which is fastened to a switch 41. The spring lever 40 can be preloaded with a spring prestress, in order to cover the necessary hysteresis range of the controlled variable. If it is raised up sufficiently, the spring lever 40 operates a button 42 on the switch 41 which then performs a switching operation on the peristaltic pump 20, in particular on the motor 21 or its controller. The setpoint value setting of the regulating circuit can take place via the spring lever 40, since the latter has a direct influence on the controlled variable. If the pressure in the paint at the pump outlet 23 drops again, the pressure in the hydraulic control line 22 will also drop across the membrane coupling 31, and the membrane 34 is lowered on the membrane switch 33 in such a way that the spring lever 40 relieves the button 42 and operates the switch 41 correspondingly.

The paint pressure line 10 is arranged so as to start from the threaded flange 50 of the base station 2. As a disturbance variable at the threaded flange 50 there, the pressure change $\Delta p1$ is propagated via the pressure line 10 as far as the paint inlet line 141 at the pressure reducing device/pressure regulator 12 at the front end 17.

The pressure fluctuation $\Delta p2$ will prevail as a disturbance variable at the paint inlet line 141 in the pressure reducing device/pressure regulator 12, depending on which paint pressure the paint pump of the base station 2 provides and how the pressure conditions have been set in the paint hose. Here, both hydrostatic and hydrodynamic effects play a considerable role. The pressure is propagated from the paint inlet line to the measuring element in the form of the hydraulic force sensor 160 which is configured in the present case as a diaphragm plate 151. The diaphragm plate is understood to be a measuring element which is defined by the setpoint value setting of a prestressed spring 154. The controlled variable is to be set in the form of from 0.3 bar to 0.4 bar in the paint outlet line 156. To this end, the hydraulic force sensor 160 or diaphragm plate 151 is moved in the direction of the spring 154 by the disturbance variables $\Delta p2$ at the paint inlet line 141, a slide 144 which is coupled to the diaphragm plate 151 narrowing or even closing the passage of the paint inlet line 141 to the diaphragm plate 151. The controlled variable of from 0.3 bar to 0.4 bar which is provided in this way at the paint outlet line 156 is subject to the disturbance variable of the dispensed paint volume and the associated pressure drop which depends on whether the needle 110 at the needle valve 105 of the spray head 13 is pulled, that is to say is open or closed. If the needle valve 105 is closed, no paint discharge takes place, with the result that the pressure which is built up in the front end 17 between the paint pressure in the paint line 10 at the paint inlet line 141 and the controlled variable in the paint outlet line 156 is adjusted. As soon as a corresponding system pressure is reached, the pressure monitor 30 will likewise switch off the paint pump via the above-described embodiment and will hold the system under static pressure. If the needle 110 is then withdrawn via the trigger 15 and paint is dispensed as a result via the needle valve 105 at the spray head 13, a volumetric flow is produced and the regulation at the second regulating circuit in the front end 17 of the paint spray gun 3 adjusts the desired paint pressure in the paint outlet line.

It goes without saying that, in addition to the paint spray gun 3 which is shown, other apparatuses for dispensing paint are also conceivable, for example paint rollers or paint brushes or the like which have a corresponding trigger or a paint dispensing valve and are supplied with paint via a paint pump by way of a paint hose.

Moreover, it is possible to operate a plurality of "paint consumers" on one paint pump, since the necessary system pressure in the paint hose or in a plurality of paint hoses downstream of a diverter at the base station with a paint pump is provided in the entire system via the pressure monitor.

Moreover, it is provided in one preferred embodiment to also make it possible to set the prestress of the spring lever 40 or a corresponding means, in order to influence the switching point.

The invention is not restricted to the embodiment which is shown; rather, it includes those refinements which make use of the concept which is essential to the invention, as indicated in the patent claims.

LIST OF REFERENCE NUMERALS

1 Paint application system
2 Base station

3 Paint spray gun
4 Paint bucket
5 Paint intake line
6 Hose guide
10 Paint pressure line
11 Connector
12 Pressure reducing device/pressure regulator
13 Spray head
14 Handle, fan
15 Trigger
16 Handle
17 Front end
20 Peristaltic pump
21 Motor
22 Pump inlet
23 Pump outlet
30 Pressure monitor
31 Membrane coupling
32 Hydraulic control line
33 Membrane switch
34 Membrane
40 Spring lever
41 Switch
42 Button
50 Threaded flange
105 Needle valve
110 Needle
141 Paint inlet line
144 Slide
151 Diaphragm plate
154 Spring
156 Paint outlet line
160 Hydraulic force sensor

The invention claimed is:

1. A paint application system having a transportable paint roller, paint brush, paint pad, or a transportable paint spraying device or paint spray gun with a fan for dispensing paint via a spray head with a paint nozzle and a needle valve, and having a base station which is stationary during the work operation for paint application and has a connector to a paint supply, the base station having a paint pump for sucking in paint from the paint supply and delivering paint by means of pressure, and the base station being connected to the paint roller, paint brush, paint pad, or the paint spraying device via a paint hose and supplying the paint roller, paint brush, paint pad, or the paint spraying device with paint, wherein the paint roller, paint brush, paint pad, or the paint spraying device comprises a pressure reducing device/pressure regulator which is connected downstream of the paint hose and regulates the paint pressure in a paint dispensing line to a paint roller, paint brush, paint pad, or a paint spray head to a substantially constant paint pressure which is lower than a paint pressure in the paint hose, wherein the paint pump in the base station is assigned a pressure monitor for monitoring the required paint pressure at the paint pump-side end of the paint hose, wherein in a first regulating circuit, the pressure monitor comprises, as a measuring element, a hydraulic control line to a switch, in particular a membrane switch, wherein the hydraulic control line being connected to a pressure side of the paint pump via a coupling means, and wherein the switch having a prestressing means, in particular a spring stressing means, which has to be overcome in order to generate a switching signal and represents a setpoint value for the paint pressure, wherein a falling pressure at the pressure monitor below a lower limiting value leading, as a controlled variable, to relieving of the switch until the latter switches on the paint pump via an electrical contact, and wherein a rising pressure at the pressure monitor above an upper limiting value leading, as a controlled variable, to loading of the switch until the latter switches off the paint pump via an electrical contact.

2. The paint application system according to claim 1, wherein communications about the paint pressure are performed between the pressure reducing device/pressure regulator and the pressure monitor, a paint pressure which falls below a first limiting value being detected in the paint hose at the paint pump-side end by the pressure monitor and actuating a switch which switches on the paint pump in order to generate a higher paint pressure in the paint hose, and a paint pressure which rises above a second limiting value at the pressure reducing device/pressure regulator being communicated to the pressure monitor and actuating a switch which switches off the paint pump.

3. The paint application system according to claim 1, wherein a first regulating circuit is provided for regulating the paint pressure at the outlet of the paint pump, and a second regulating circuit is provided for regulating the paint pressure at the paint dispensing line.

4. The paint application system according to claim 1, wherein the pressure monitor is arranged between the paint pump and the paint hose in the base station.

5. The paint application system according to claim 1, wherein the pressure reducing device is arranged in the transportable paint roller, paint brush, paint pad, or the paint spraying device downstream of the paint inlet line or the paint hose and upstream of the paint dispensing line.

6. The paint application system according to claim 5, wherein the hydraulic control line is configured as a flexible line, in particular as a rubber line with an elastic extensibility.

7. The paint application system according to claim 5, wherein a control fluid in the form of oil is arranged in the hydraulic control line.

8. The paint application system according to claim 5, wherein the coupling means is configured as a pressure diaphragm, the said coupling means being integrated substantially without edges and dead spaces into a paint duct on the pressure side of the paint pump.

9. The paint application system according to claim 1, wherein the paint pump is configured as a peristaltic pump, in particular as an annular segment-shaped peristaltic pump.

10. The paint application system according to claim 1, wherein, in a second regulating circuit, the pressure reducing device/pressure regulator comprises, as measuring element, a hydraulic force sensor, in particular a diaphragm plate, the hydraulic force sensor being connected via a paint inlet line to a pressure side on the paint hose, and the hydraulic force sensor having a prestressing means, in particular a spring stressing means which is loaded on the rear side, which has to be overcome in order to generate a movement and represents a setpoint value for the reduced paint pressure in a paint outlet line, a pressure range at the paint outlet line, in particular between 0.3 and 0.4 bar, being regulated, as a controlled variable, via a slide which is arranged on the hydraulic force sensor, in such a way that, in the case of a movement of the hydraulic force sensor, the slide enlarges or reduces the passage cross section from the paint inlet line to the hydraulic force sensor, in order to permit a larger or smaller introduction of pressure from the pressure side on the paint hose.

* * * * *